United States Patent [19]

Fujita et al.

[11] 4,023,392

[45] May 17, 1977

[54] METHOD AND APPARATUS FOR COOLING HOT ROLLED ROD

[75] Inventors: Tatsu Fujita, Kobe; Yoshiro Yamada, Akashi; Atsuo Mizuta; Tetsuo Yamada, both of Kobe; Osamu Tsuda, Kobe; Tsugio Kaneda, Akashi; Shinichi Shimazu, Kobe; Yukio Wada, Osaka, all of Japan

[73] Assignee: Kobe Steel Ltd., Kobe, Japan

[22] Filed: Jan. 19, 1976

[21] Appl. No.: 650,448

[30] Foreign Application Priority Data

Jan. 18, 1975 Japan ..... 50-8096

[52] U.S. Cl. ..... 72/201; 140/2; 148/156; 148/157; 266/106

[51] Int. Cl.[2] ..... B21B 45/02; B21B 43/08; B21F 21/00; C21D 1/62

[58] Field of Search ..... 72/200, 201, 202; 140/2; 148/12 B, 153, 155, 156, 157; 266/106

[56] References Cited

UNITED STATES PATENTS

| | | | |
|---|---|---|---|
| 3,390,871 | 7/1968 | McLean et al. | 148/156 X |
| 3,452,785 | 7/1969 | McLean et al. | 140/2 |
| 3,865,153 | 2/1975 | Vitelli | 140/2 |
| 3,940,961 | 3/1976 | Gilvar | 140/2 X |
| 3,940,967 | 3/1976 | Vitelli | 72/201 |

*Primary Examiner*—Carl E. Hall
*Assistant Examiner*—E. M. Combs
*Attorney, Agent, or Firm*—Oblon, Fisher, Spivak, McClelland & Maier

[57] ABSTRACT

A method and apparatus for cooling a rod of a coil form, immediately after the hot-rolling thereof and within which the rod, whose loops are spaced a given pitch from one another, is laid flat upon a chain conveyor, and more particularly upon rails thereof, and transported therealong by means of endless chains, includes the cooling of the rod with cooling fluid or air which is introduced from below the cooling floors through means of nozzle portions formed within the bodies of the cooling floors. The method and apparatus features the arrangement and construction, including the configuration, of the nozzle portions thus formed, the cooling fluid being projected upwardly at an angle within the range of 10°–70° with respect to the plane of the cooling bed, and horizontally at an angle within the range of 10°–150° with respect to the transporting direction of the rod, towards the rod directly above the rail and chain portions of the conveyor, as well as being projected upwardly at an angle within the range of 15°–75° with respect to the plane of the cooling bed, and horizontally at an angle within the range of 30°–150° with respect to the direction of the transportation of the rod, towards the overlapped, sidewise circumferential portions of the rod. Thus, uniform cooling may be achieved over the entire length of the coiled rod.

7 Claims, 31 Drawing Figures

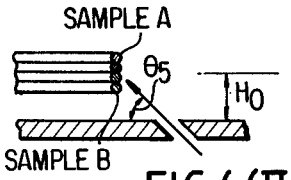
FIG.6(IIA)
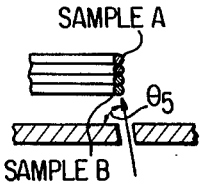
FIG.6(IIB)

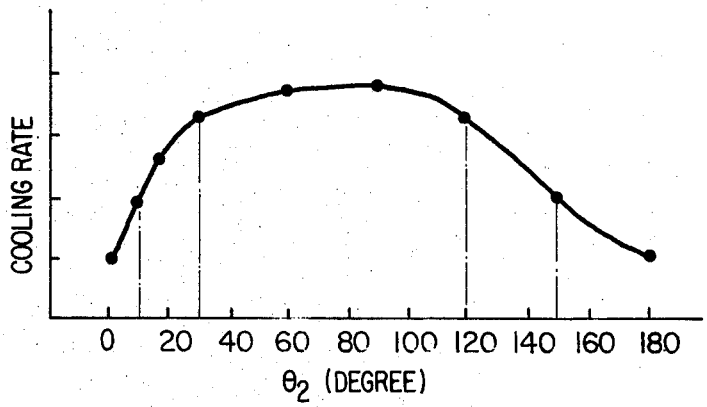
FIG.6(III)
FIG.6(IV-1)
FIG.6(IV-1)A
FIG.6(IV-2)

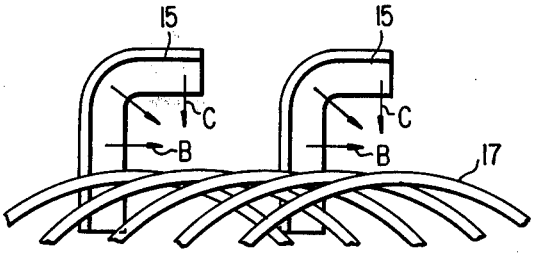
FIG.9(III)

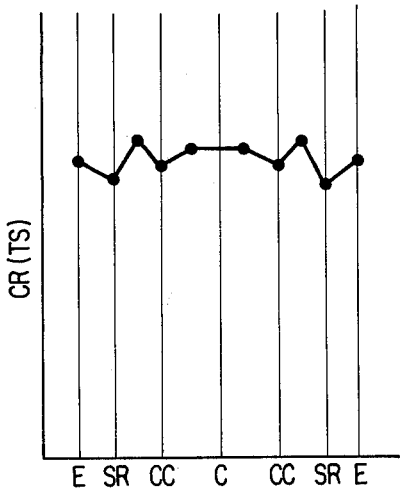
FIG. 16(III)

METHOD AND APPARATUS FOR COOLING HOT ROLLED ROD

BACKGROUND OF THE INVENTION

1. Field of the Invention:

The present invention relates generally to a method and apparatus for cooling a rod of a coil form, immediately after the hot-rolling thereof, and more particularly to improvements in the arrangements of the nozzle portions provided within the bodies of the cooling floors themselves, which nozzle portions project cooling fluid against the rod of the coil form during it transportation upon a chain conveyor, a series of loops of the aforenoted rod being laid flat upon the chain conveyor and spaced at a given pitch from one another.

2. Description of the Prior Art:

It has been a common practice when cooling a rod of a coil form, that immediately after the hot-rolling thereof, the hot-rolled rod is wound into a coil form by means of a laying cone, and subsequently, a series of loops of the rod is sequentially placed upon a conveyor, and more particularly upon the rails thereof whereby the wire loops are able to be transported by means of endless chains along the cooling bed with the series of loops of the rod being laid flat upon the rails and spaced at a given pitch from one another, during which time cooling fluid is projected upwardly through means of nozzles provided within the cooling floors so as to thereby cool the rod for heat treatment thereof.

Another attempt is disclosed within Japanese Patent Publication No. Sho 42-15463, within which an increased quantity of air is projected against the lateral high density portions of the rod loops, while the quantity of cooling air being projected against the central portion of the rod is simultaneously decreased, as viewed in the transverse direction, for the pupose of achieving uniform cooling of the rod.

Still other attempts have been disclosed within Japanese Patent Application No. Sho 49-15608 and Japanese Patent Application No. Sho49-15609, within which a large quantity of air is projected against the lateral high density portions of the rod, while the rod of the coil form is oscillated vertically or conveyed in a zig-zag pattern upon a coding bed so as to similarly achieve uniform cooling of the rod. However, these prior art attempts nevertheless pose problems which remain unsolved.

More particularly, as seen within FIGS. 1 and 2, it has been a general practice that the hot-rolled rod is transferred from a laying cone 1 onto a cooling bed 3 in the form of a coil 4 whose loops are laid flat thereon and spaced at a given pitch from one another. The rod is disposed upon rails 5 provided upon the cooling bed 3 and transported thereon by means of endless conveyor chains 6 which are disposed parallel to the rails 5. During the transportation of the rod, the rod is cooled with air streams being projected through nozzles 7 provided within the cooling bed 3. However, as the rod 4 of the coil form is placed upon the rails 5 and transported by means of the chains 6, by being hooked by means of fingers of the chains 6, the result is that the portions of the rod which contact the rails 5 and chains 6 will not be sufficiently cooled with cooling fluid because the cooling fluid being projected through means of the nozzles 7 is directed parallel with the rails 5 and chains 6. This leads to an increase in the extent of variation in the cooling rate of the rod over the entire length thereof, and hence an increased extent in the variation in the mechanical strength thereof.

Another difficulty in cooling a rod of a coil form is that the lateral circumferential portions of the loops of the rod provide high density portions, as viewed in the vertical direction, whereby the cooling fluid cannot readily penetrate such high density areas, as compared with the central portion of the loops of the rod which are spaced a further distance from each other than the loops of the aforenoted high density portions of the rod.This then leads to the failure to provide uniform cooling for the rod, and hence uniform mechanical properties thereof.

As has been described earlier, to cope with these problems, there have been proposed many attempts such as disclosed within Japanese Patent Application No. Sho 49-15608 and Japanese Patent Application No. Sho 49-15609, within which a rod of a coil form is oscillated in the vertical direction, or alternatively, a rod is transported, following a zig-zag pattern, in an attempt to achieve uniform cooling. However, this brings about other shortcomings, that is, the possiblity of causing variation in the pitch of the loops, an irregular shape of the loops, and cracking within the skin of the rod due to such oscillations or vibrations. In addition, the construction of the apparatus becomes quite complex, thereby also presenting the possiblity of not using the same in practical applications.

SUMMARY OF THE INVENTION

Accordingly, it is an object of the present invention to avoid the aforenoted shortcomings experienced with the prior art cooling methods and apparatus of the type described.

Another object of the present invention is to provide a method and an apparatus for uniformly cooling a hot-rolled rod in the form of a coil, thus avoiding variations in the quality of the rod.

Still another object of the present invention is to provide a method and an apparatus for efficiently uniformly cooling a rod of a coil form by improving the directions of the projected air streams without increasing the velocity of the cooling fluid in proportion to the density of the loops of the rod.

Yet another object of the present invention is to provide a method and an apparatus for uniformly cooling a rod of a coil form over the entire length thereof by cooling such portions of the rod, which are positioned immediately above the chains and rails of a conveyor, without varying the pitch of the loops of the rod.

The foregoing and other objects of the present invention may be readily attained in accordance with the method and apparatus of the present invention wherein, according to one aspect of the present invention, there is provided a method and an apparatus for cooling a rod of a coil form, during the transportation of the rod upon a cooling bed, a series of the coil loops of the aforenoted rod being laid flat upon rails of the bed, while spaced through means of a given pitch from one another, and cooled with cooling fluid being projected upwardly from below the cooling bed. Within this method and apparatus, cooling fluid is projected upwardly at an angle within the range of 10° – 70° with respect to the plane of the cooling bed, and horizontally at an angle within the range of 10° – 150° with respect to the transporting direction of the rod, toward the rod disposed directly above the rail and chain portions of the cooling bed and is additionally projected upwardly at an angle within the range of 15° – 75° with respect to the plane of the cooling bed and horizontally at an angle within the range of 30° – 150° with respect to the transporting direction of the rod towards the overlapped, lateral circumferential portions of the loops of the rod, that is, the high density portions of the loops of the rod, thereby achieving uniform cooling over the entire length of the coiled rod.

According to another aspect of the present invention, there is also provided a method and an apparatus of the type described hereinabove, wherein the nozzle portions are formed within the body portions of the cooling bed disposed directly beneath the chains as well as within the rails themselves, by modifying part of the construction of the cooling bed so as to form the nozzles.

According to still another aspect of the present invention, there is further provided a method and an apparatus of the type described hereinabove, wherein the rails disposed on one cooling bed are arranged out of lengthwise alignment with those disposed within another cooling floor or bed.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein:

FIGS. 6(IV-1) and 6(IV-1)A are a graphical plot and schematic view, respectively, showing the relationship between the horizontal angles of the direction of the rod axis with respect to the projecting direction of the cooling fluid, and the cooling rates of the rod;

DETAILED DESCRIPTION OF THE ILLUSTRATED EMBODIMENTS

Figure 3:
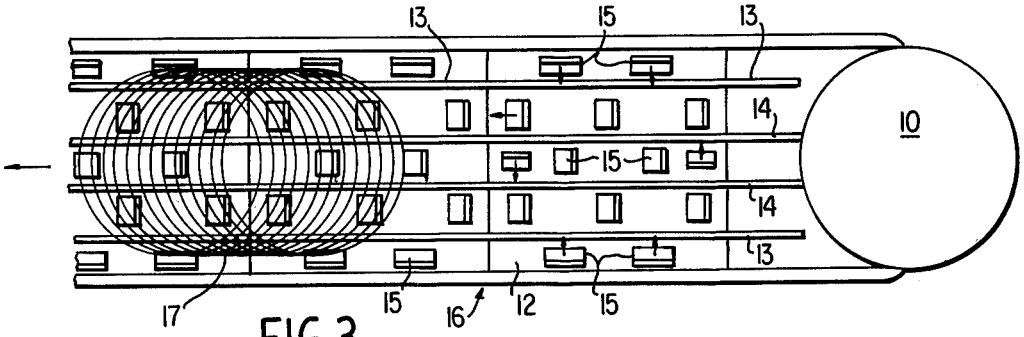
FIG. 3 is a plan view of one embodiment of the cooling apparatus constructed in accordance with the present invention and showing its cooperative parts.

Referring now to the drawings, and more particularly to FIG. 3 thereof, there is shown a laying cone 10, a cooling bed 12, a pair of rails 13, for holding a rod thereon, axially disposed along opposite sides of the cooling bed, and a pair of axially disposed chains 14 interposed between the aforenoted pair of rails 13 and disposed parallel thereto. A cooling apparatus, generally indicated by the reference character 6, includes the cooling bed 12, and a plurality of air chambers, not shown, disposed thereunder, rails 13 and endless chains 14 being disposed upon the cooling bed 12 with respective rails and chains within one cooling bed being in lengthwise alignment with those within another cooling bed.

A rod 17, formed into a coil immediately after a hot-rolling process, is sequentially paid out from the laying cone 10 as shown and disposed upon the rails 13 with a series of loops of the rod being spaced a given pitch from one another. In this respect, the loops of the rod are gripped or hooked by means of fingers, not shown, of endless chains 14 so as to be sequentially transported in a given direction.

During such sequential transportion of the loops of the rod 17, cooling fluid or air is injected, from below, upwardly through nozzle portions 15, formed within the cooling bed 12 which is disposed above an air chamber, toward the rod 17 so as to thereby cool the same. In this manner, however, as the rod 17 of the coil form is held upon the rails 13, the portions of the rod which contact the rails are not sufficiently cooled by means of the aforenoted injected cooling fluid. In addition, the portions of the rod which are hooked by means of the chains 14 are also not cooled with the cooling fluid, and as a result, there arises a lack of uniformity in the cooling conditon between the portions of the rod immediately disposed above the rails 13 and chains 14, and the remaining portions of the rod, and this, in turn, necessarily leads to a lack of uniformity in the mechanical properties of the rod throughout the entire length thereof.

Similarly, as the rod of the coil form is laid flat upon the rails 13, a series of loops of the rod are spaced a given pitch from one another, and consequentially, the density of the central portion of the rod loops, as viewed in the transverse direction, is low, that is, the spacings between the overlapped rod loops are rough or large, while the density of the overlapped, sidewise circumferential portions of the rod is high, that is, the spacings of the sidewise overlapped portions of the rod loops are small. This brings about a difference in the cooling rate of the rod in the transverse direction of the length of rod loops with a resulting increased variation in the mechanical properties of the rod.

The present invention is therefore intended to provide a method and an apparatus for uniformly cooling the rod by providing improvements in the arrangement and construction, including the configurations thereof, of the openings of the nozzle portions 15. In other words, according to the present invention, not only the high density portions, but also other portions of the rod disposed immediately above the rails and chains, may be uniformly cooled, as are the other portions of the rod, thereby providing uniform cooling of the rod throughout the entire length thereof, with resulting uniform mechanical properties.

Figure 4:
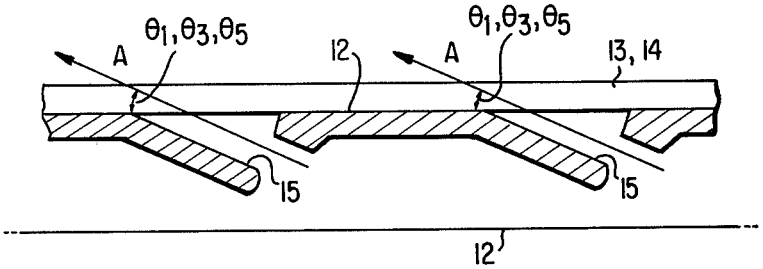
FIG. 4 is a longitudinal cross-sectional view of the nozzle portions used within the apparatus of the present invention.

Referring then to FIG. 4, there is shown a more detailed construction of the nozzle portions 15 formed within the cooling bed 12. The reason for the use of the term "nozzle portion" herein is that the nozzles are not separately provided with respect to the cooling bed, as is the case of the prior art, but to the contrary, are integrally formed within the cooling bed 12.

As can be seen from FIG. 4, the nozzle portions may be designed such that the cooling fluid is directed upwardly at an angle of $\theta 1$ relative to the cooling bed 12 for cooling the rail portions, at an angle of $\theta 3$ for cooling the chain portions, and at an angle of $\theta 5$ for cooling the high density portions, that is, the sidewise portions of the loops of the rod, respectively, the cooling air being injected in the direction of arrow A. It is noted further however, that the direction A includes a direction B, shown within FIG. 5, which coincides with the transporting direction of the rod, as well as a direction C, also shown within FIG. 5, which defines an angle $\theta 2$ with the transporting direction of the rod within a horizontal plane. Still further, the direction A also includes a direction which defines an angle $\theta 4$ with the transporting direction of the rod, in the case that the cooling fluid is injected towards the sidewise, high density portions of the rod loops.

The angles $\theta 1$–$\theta 5$ are so designed that the cooling fluid may function most efficiently and the respective portions of the rod loops may be cooled uniformly, taking into consideration the widths of the chains and rails, the height of the loops as measured from the cooling bed, and the density of the rod loops. FIG. 6 shows the relationship between these angles and the portions of the rod loops to be cooled thereby.

Figure 6I:
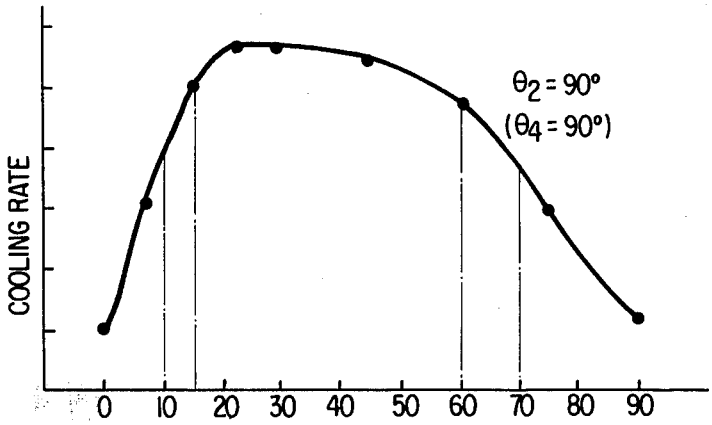
FIGS. 6(I) and (II) are graphical plots showing the relationship between the angles of the directions of the cooling fluid, being projected through the nozzle portions with respect to the cooling bed, and the cooling rates of a rod.
Figure 6:
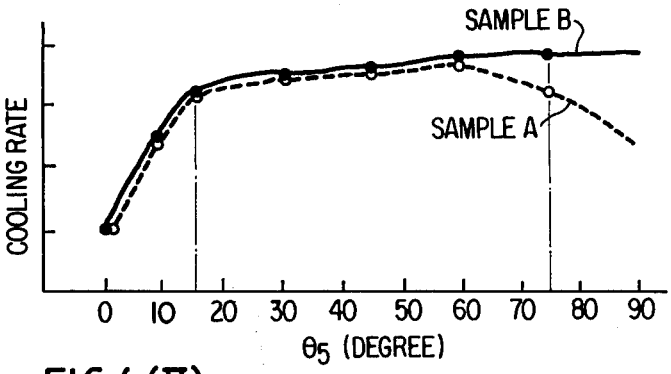
FIGS. 6(III) and 6(IV-2) are graphical plots showing the relationship between the horizontal angles of the directions of the cooling fluid being projected through the nozzle portions of the bed with respect to the transporting direction of the rod, and the cooling rates of the rod.

As shown within FIG. 6(I), if $\theta 1$ and $\theta 3$ are less than 10°, then the positions of the openings of the nozzle portions will be disposed too far from the chains to inject the cooling fluid against the chains and rails disposed directly above the same, and consequently, there occurs a sharp decrease in the cooling rate, that is, the cooling rate is low, due to a decrease in the velocity of the cooling fluid. On the other hand, if $\theta 1$ and $\theta 3$ are more than 70°, then there will be created a dead zone directly above the chains and rails, and thus the cooling rate of the rod directly above the chains and rails will also be decreased to a low value. For this reason, $\theta 1$ and $\theta 3$ should range from 10° – 70° for efficient cooling, and preferably from 15° – 60°.

As shown within FIG. 6(III), if $\theta 2$ is less than 10°, the positions of the nozzle portions will be disposed too far from the rod disposed directly above the chains and rails, and consequently, the velocity of the cooling fluid will be lowered whereby the cooling rate is effectively lowered. On the other hand, if $\theta 2$ is more than 90°, then the direction of one component of the cooling fluid will be reversed with respect to the transporting direction of the rod with the result that there arises an impingement of the aforenoted cooling fluid with the other cooling fluid which is being projected parallel with the transporting direction of the rod thus also resulting in a lowered cooling rate, and if $\theta 2$ is more than 150°, this effect becomes prominent. For this reason, $\theta 2$ should range from 10° – 150°, and preferably from 30° – 120°.

Similarly in order to achieve an efficient cooling for the rod of the coil form by means of the nozzle portions, there should also be taken into consideration the direction of the rod loops within a high density portion thereof, and the direction of the overlapping loops. FIG. 6(II) shows the relationship between the fluid flow directed in the upward direction as determined by angle $\theta 5$, and the cooling rate of a high density portion of the rod loops, and it can be appreciated that the cooling rates of the upper rod loops (Sample A) and the lower rod loops (Sample B) differ from one another, in the case that $\theta 5$ is large as disclosed within FIGS. 6(IIA) and FIGS. 6(II B).

If $\theta 5$ exceeds 75°, then the cooling rate of the upper portions of the rod loops exhibits a sharp decrease as compared with that of the lower rod loop portions thus presenting a considerable difference therebetween, and this difference will be increased further with a further increase in $\theta 5$. It is thus seen that if $\theta 5$ is greater than 75°, a variation in the cooling rate within the high density portion occurs, while, on the other hand, if $\theta 5$ is less than 75°, such a variation is not evident. However, if $\theta 5$ is less than 15°, then the positions of the openings of the nozzle portions will be disposed too far from the rod loops thereby presenting a low cooling rate therefor. As a result, in order to obtain an efficient cooling rate which is free of variations $\theta 5$ should range from 15° – 75°.

Referring now to FIGS. 6(IV-1) and 6(IV-1)A, the effect of the direction $\alpha$ of the cooling fluid upon the cooling rate of the rod loops is disclosed, and as can be seen from these Figures, in the instance that the cooling fluid is projected in the direction at an angle of between 30° – 150° with respect to the axial direction of the rod, a high cooling rate results. Since the direction of the rod loops within the high density portions substantially coincides with the transporting direction of the rod, the angle $\theta 4$ of the nozzle portions for a high density portion within the horizontal plane, as shown within FIG. 6(IV-2), should range from 30° – 150°, because, if it is not within this range, a sharp decrease in the cooling rate results due to the aforenoted misdirection of the cooling fluid, as well as the increased distance between the rod and the nozzle portions.

Figure 17:
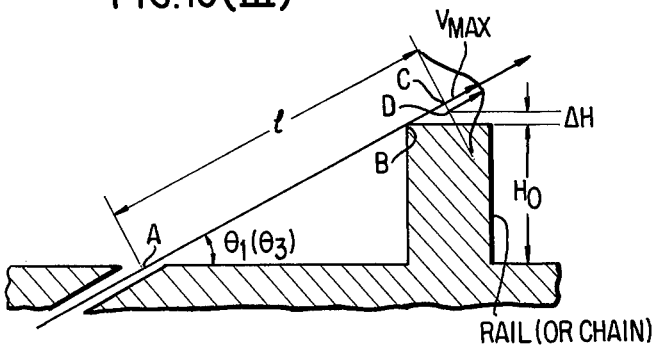
FIG. 17 is a transverse cross-sectional view of the cooling bed showing the cooling fluid flow path velocities.
Figure 17A:
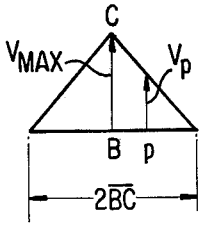
FIG. 17A is an enlarged schematic diagram illustrating the fluid flow path velocities characteristic of the appratus of FIG. 17.

Referring now to FIGS. 17 and 17A, assume that a rod is positioned at a point P directly above the chains or rails, and that the velocity of the cooling fluid at the exit of the nozzle portion is Vo, the velocity of the fluid at the point P is $V_P$, and the maximum velocity of the fluid within the plane including the point P is Vmax. Then, Vmax will be obtained by the following empirical formula:

$$V\max = l^{-1/3} \times V_o$$

wherein l = the distance from the nozzle exit to the point P, and since BC<<AB, then BC = 0, and $$V\max = \left(\frac{Ho}{\sin\theta 1}\right)^{-1/3} \times Vo$$

$$= \left(\frac{\sin\theta 1}{Ho}\right)^{1/3} \times Vo \qquad (1)$$

wherein Ho represents the height of the chains and rails as measured from the cooling bed, and Δ H represents the distance or height of a rod point P above the chains and rails. In addition, as the spread of the cooling fluid, when the rod advances from point B to point C, is considered to be approximately twice BC, the velocity of the cooling fluid at the point P will be given approximately, referring to FIGS. 17 and 17A, as:

$$Vp = V\max \times \left\{1 - \frac{BC - \frac{\Delta H}{\sin\theta_1}}{BC} \times \tan\theta_1\right\}$$

$$= \left(\frac{\sin\theta 1}{Ho}\right)^{1/3} \times \left\{1 - \frac{BC - \frac{\Delta H}{\sin\theta_1}}{BC} \times \tan\theta_1\right\} \times Vo \qquad (2)$$

The values obtained according to the above formula are plotted within FIG. 6-I within which, with larger $\theta 1$ and $\theta 3$ values, the more sharply will increase the factor $$\left(\frac{\sin\theta 1}{Ho}\right)$$

within formula (2). On the other hand, when $\theta 1$ and $\theta 3$ are small, the position of the nozzle portion will be disposed further from the chains whereby the velocity of the cooling fluid is lowered. $\theta 1$ and $\theta 3$ thus show a peak within the range of 20° – 30°, and the velocity of the cooling fluid is decreased when $\theta 1$, $\theta 3$ exceeds 60°, and consequently, $\theta 1$ and $\theta 3$ should have values within the range of 10° – 70°, and preferably within the range of 15° – 60°.

$$CR \propto \sqrt{V_p} \qquad (3)$$

It is thus seen that according to the inventors' experiments, the cooling rate CR is proportional to $\sqrt{V_P}$ as shown within the formula (3).

Figure 7:
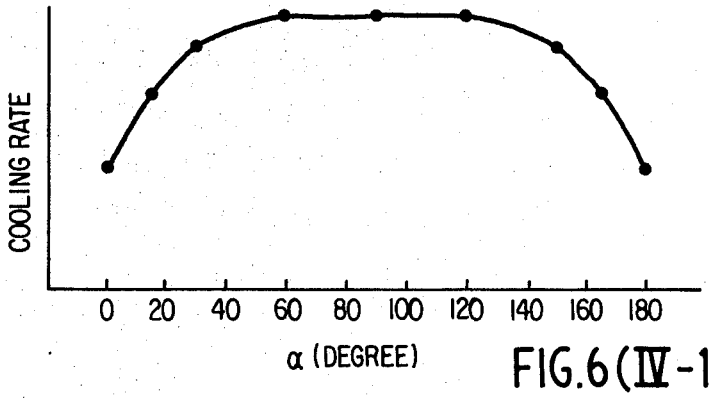
FIG. 7 is a graphical plot showing the relationship between the cooling rate and the tensile strength of the rod.
Figure 7:
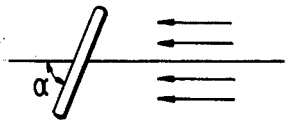
Figure 7:
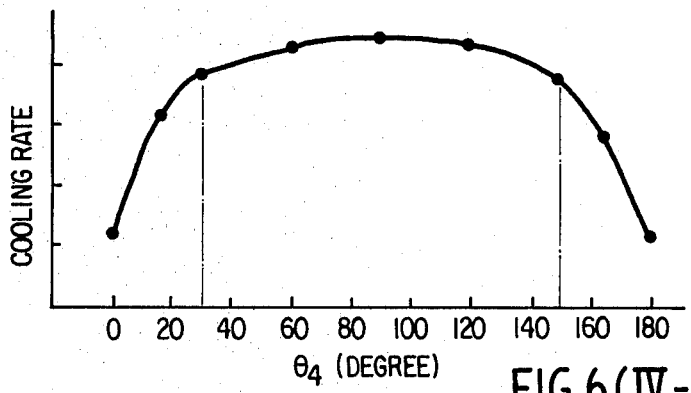
Figure 7:
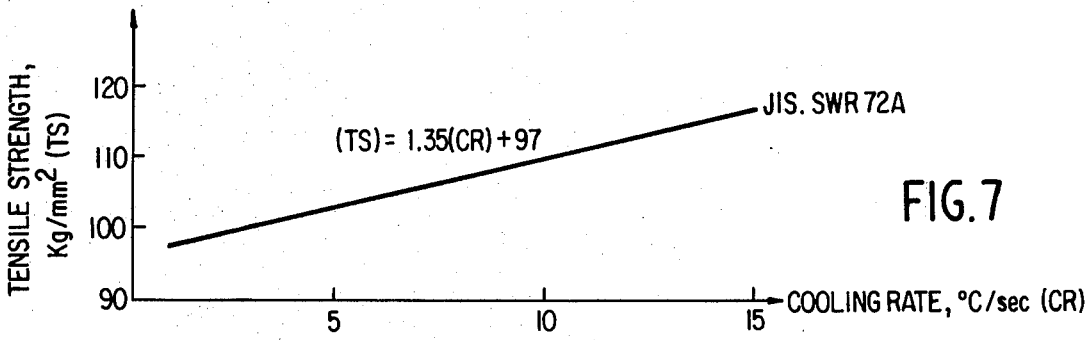

With reference now being made to FIG. 7, there is illustrated the relationship between the cooling rates of a JIS SWRH72A rod, which may have a diameter of between 5.5 – 13 mm and has been subjected to hot rolling, and the resulting tensile strengths thereof. As can be seen from this figure, the cooling rate of the rod is substantially in proportion to the resulting tensile strength. The inventors have confirmed that the above relationship is maintained between the above two factors, irrespective of the types of steels and the diameters of rods, and this means that a reduction in the variation in the cooling rate necessarily leads to a reduction in the variation of the mechanical properties, that is, the tensile strengths of the rod.

Figure 5:
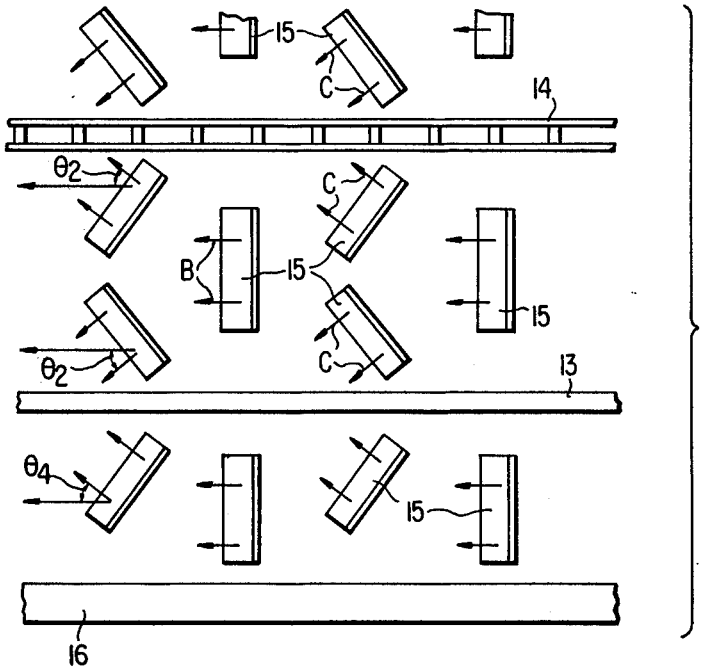
FIG. 5 is a partial plan view of the apparatus of the present invention showing the arrangement of the nozzle portions within each apparatus.
Figure 8I:
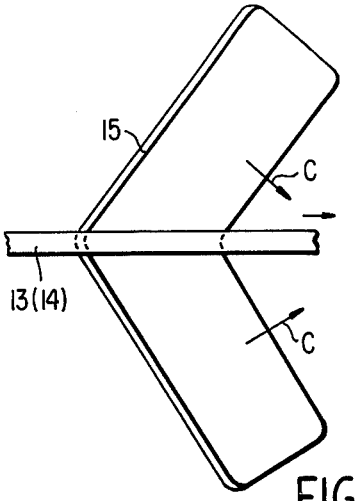
FIGS. 8(I) and 8(II) are plan views illustrative of various embodiments of the nozzle portions disposed below the chain and rail portions of the apparatus of the present invention.
Figure 8:
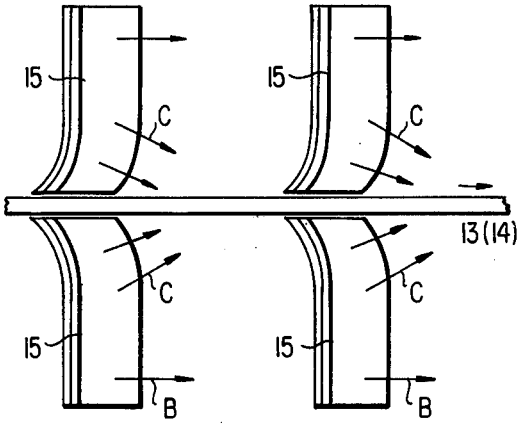
Figure 9I:
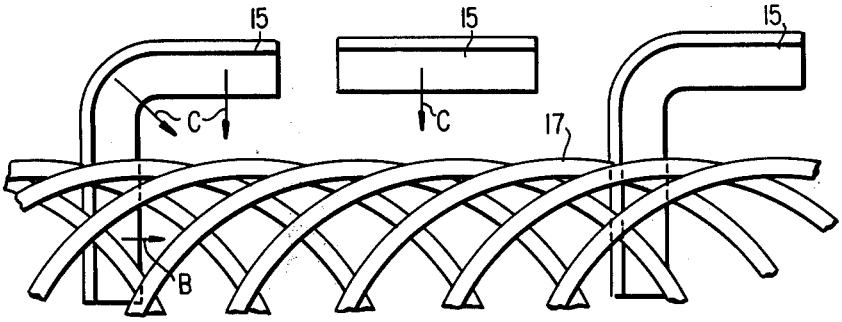
FIGS. 9(I), 9(II), and 9(III) are plan views of several embodiments and arrangements of cooling-fluid-projection nozzle portions for high density portions of the loops of the rod utilized in accordance with the present invention.

As shown within FIG. 5, the nozzle portions may be separately disposed and positioned upon opposite sides of the rails 13 and chains 14, however, as shown within FIG. 8(I), each nozzle portion may be provided so as to have a substantially L-shaped configuration with the intersection point of the two leg portions thereof disposed directly below the rail 13. Alternatively, as shown within FIG. 8(II), a pair of separately independent nozzle portions 15 may be provided upon opposite sides of the rail 13 and chain 14, respectively, the configurations of the aforenoted nozzle portions 15 being such as to permit the simultaneous projection of the cooling fluid either in the longitudinal direction B or in the lateral direction C. Furthermore, as shown within FIG. 9(I), a substantially L-shaped nozzle 15 which permits projection of the cooling flud all along the extent thereof and therefore either in the longitudinal direction B or in the lateral direction C, for high density portions of the rod loops, may be used in combination with a nozzle 15 which permits the projection of the cooling fluid only in the lateral direction C.

Figure 9:
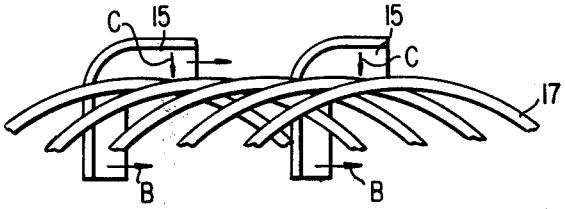

Still yet further, as shown within FIG. 9(II), only nozzle portions or members which permit the simultaneous projection of the cooling fluid in the longitudinal direction B and in the lateral direction C, may be used, or still yet alternatively, as shown within FIG. 9 (III) and as compared with FIG. 9(II), the dispositon of the nozzles may be adjusted with respect to the disposition of the coil 17, and while the issuing directions of the cooling fluid through the nozzle portions may intersect each other, thus somewhat neutralizing the velocities of the two streams of cooling fluid, such an arrangement may nevertheless enjoy superiority over a nozzle which permits projection of the cooling fluid in only the longitudinal or transporting direction B of the rod thus still presenting an improved cooling rate for high density portions of the rod loops.

It is to be noted that the cooling bed 12 consists of a plurality of cast iron plates which may be placed over the air chamber so as to thereby define the cooling apparatus 16. Alternatively, each cooling bed may be reversely directed with respect to the direction of the cooling bed plates as shown, and in this manner, the direction A of the cooling fluid being projected through the nozzle portions 15 is counter to the transporting direction of the rod 17, such relative dispositon serving to increase the relative speed of the cooling thereof.

The cooling fluid is projected through the nozzle portions in the following manner. Air is fed from a fan, not shown, into an air chamber so as to be accumulated therein, and subsequently, the internal pressure of the air within the air chamber is increased above atmospheric pressure, whereupon the air or cooling fluid is projected, through the nozzle portion 15 formed within the cooling apparatus 16, towards the rod 17 of the coil form, which is being transported in a given direction, from below in an upwardly inclined manner thereby cooling the rod of the coil form.

Figure 10:
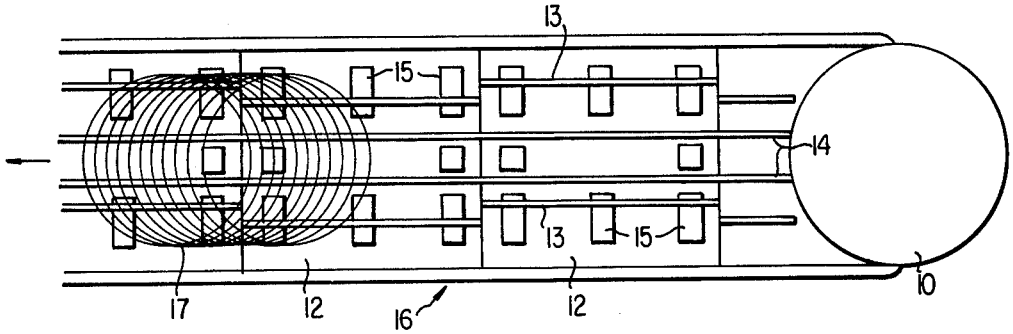
FIG. 10 is a plan view showing another embodiment of the cooling apparatus constructed according to the present invention.
Figure 11:
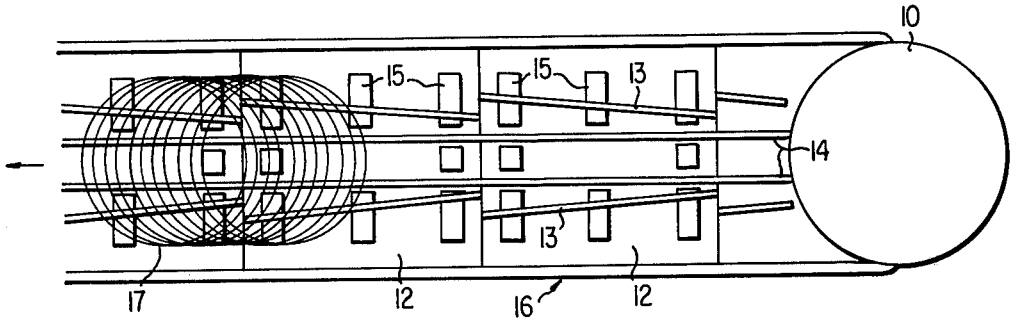
FIG. 11 is a plan view showing a further embodiment of the cooling apparatus constructed according to the present invention.

FIGS. 10 and 11 disclose cooling apparatus within which the rails 13 disposed within one cooling bed are positioned out of lengthwise alignment with those within another bed. More particularly, within FIG. 10, rails 13 provided within one cooling bed are laterally offset with respect to those disposed within the other bed, and as seen within FIG. 11, the rails 13 within each cooling bed are arranged so as not to be parallel with the chains 14. Such arrangements of rails 13 prevent specific portions of the rod from contacting the rails 13 at all times, and thus, the portions of the rod disposed directly above the rails will be sufficiently cooled.

Figure 12:
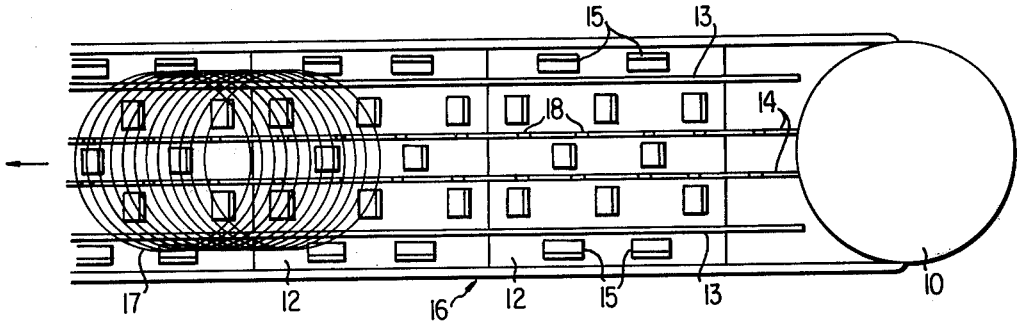
FIG. 12 is a plan view showing a still further embodiment of the cooling apparatus constructed according to the present invention.
Figure 14:
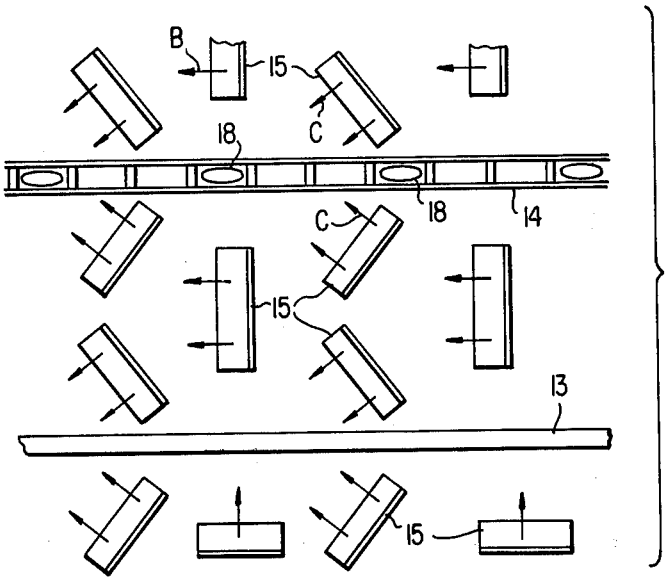
FIG. 14 is a plan view showing another embodiment of the nozzle portions utilized within the apparatus of the present invention.
Figure 15:
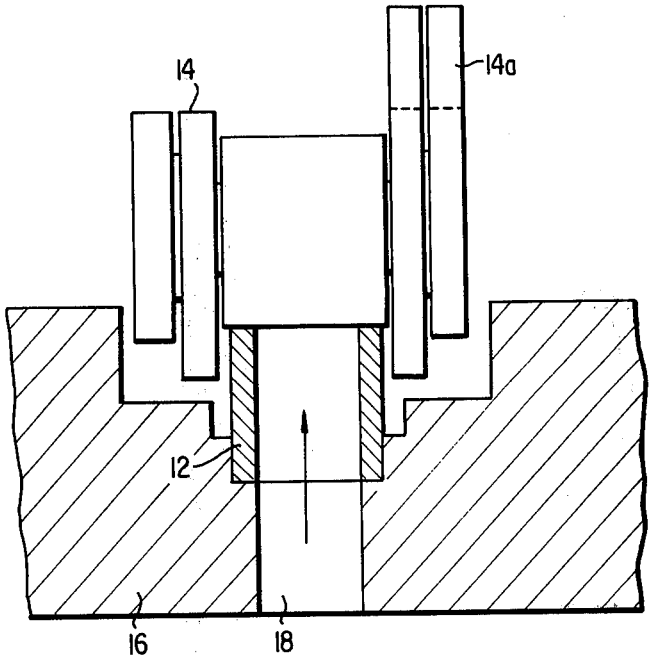
FIG. 15 is a transverse, vertical cross-sectional view of a nozzle portion utilized within the apparatus of FIG. 14.

With reference now being made to FIGS. 12, 14 and 15, there is disclosed the instance wherein projection nozzle portions 18 are disposed within the cooling bed directly below the chains whereby the cooling fluid being projected through nozzle portions 18 are directed to the fingers 14*a* of chains 14 so as to forcibly cool such portions of the rod which are hooked by means of the fingers 14*a*. This prevents the lowering of the cooling effect upon such portions of the rod which are disposed directly above the chains thereby insuring uniform cooling of the rod over the entire length thereof.

Figure 13:
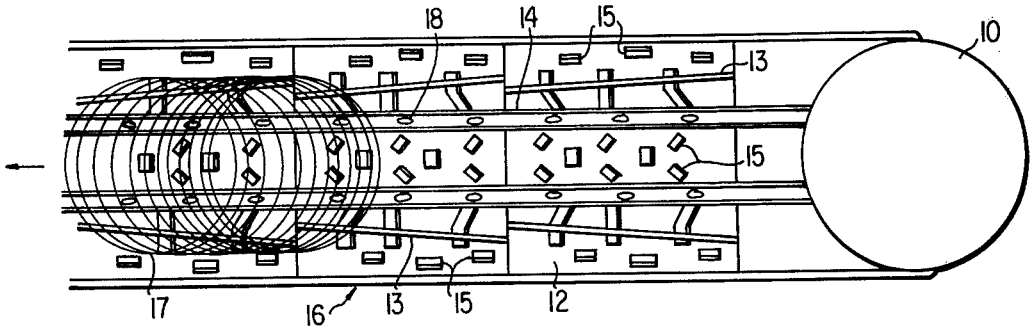
FIG. 13 is a plan view showing a yet further embodiment of the cooling apparatus constructed according to the present invention.

FIG. 13 illustrates the combined use of the nozzle portions 15, through which the cooling fluid is projected from below in the upwardly inclined manner, with nozzle portions 18, through which the cooling fluid is projected upwardly from positions disposed directly below the chains. In addition, rails 13 disposed within one cooling bed are positioned out of lengthwise alignment with those disposed within another bed, that is, the rails within each cooling bed are not parallel with the chains, such an arrangement further insuring the uniform cooling of the rod.

Figure 16I:
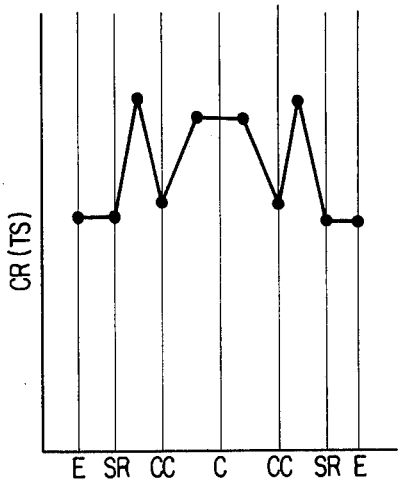
FIG. 16(I) PRIOR ART
FIGS. 16(I), 16(II), 16(III), and 16(IV) are graphical plots comparing the cooling rates of rod portions obtained according to the present invention, with those of rod portions obtained according to the prior art.
Figure 16:
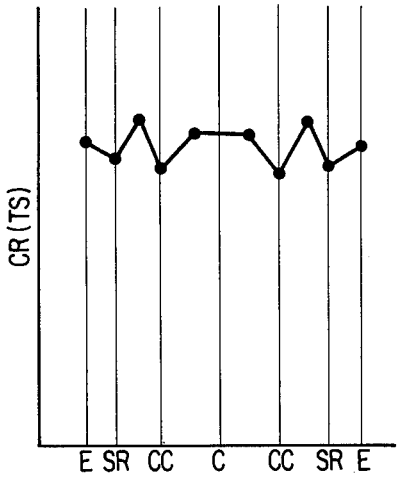
Figure 16:
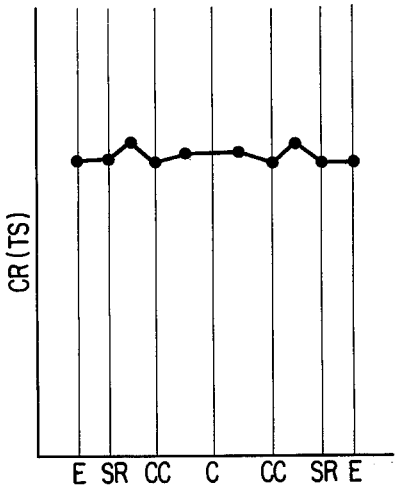

Turning now to FIG. 16, there is shown the cooling rates of a rod as measured in the transverse direction of the cooling bed. SR represents a side rail portion, CC represents a chain conveyor, C represents the center portion, as viewed in the transverse direction of the cooling bed, and E represents the sidewise high rod-density portions of the rod loops.

Figure 1:
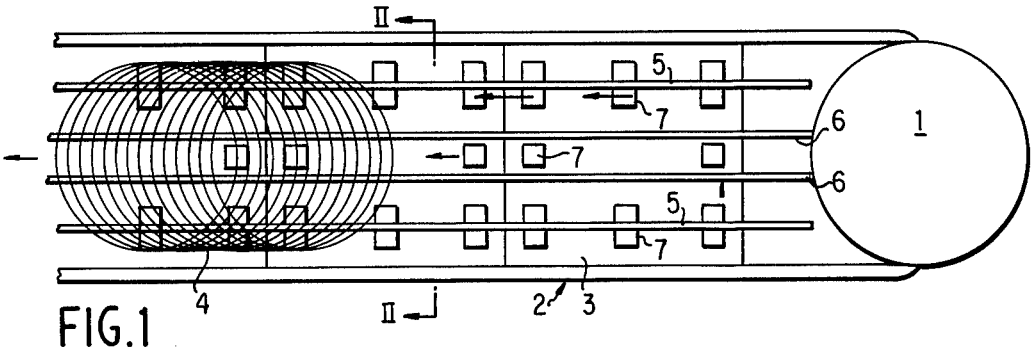
FIG.1 PRIOR ART
FIG. 1 is a plan view of a prior art cooling apparatus for cooling a hot-rolled rod.
Figure 2:
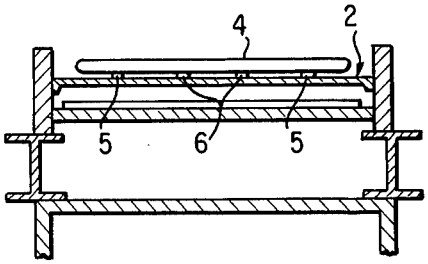
FIG.2 PRIOR ART
FIG. 2 is a cross-sectional view of the prior art apparatus of FIG. 1, taken along the line II—II of FIG. 1.

FIG. 16(I) illustrates the cooling rates of the rods according to the prior art cooling apparatus as shown within FIG. 1, wherein a large extent of variation in the cooling rates of the respective portions of the rod occurs, with resulting variance in mechanical properties, that is, the standard variation in tensile strength $\sigma = 1.98$ (*Kg*/mm²), and an average tensile strength $\bar{x} = 97.2$ (*Kg*/mm²). According to this example then, it is seen that the SR, CC, and E portions are insufficiently cooled, while the C, and the rod porton interposed between the SR and CC, portions are excessively cooled.

FIG. 16(II) illustrates the cooling rates of the rods according to the cooling apparatus shown within FIG. 3 of the present invention, and in this instance, the angles of the nozzle portions associated therewith were as follows:

$\theta 1 = 45°$, $\theta 2 = 90°$, $\theta 3 = 45°$, $\theta 4 = 90°$, and $\theta 5 = 45°$. The standard variation in the tensile strength $\sigma$ obtained was 1.33 (Kg/mm²) and the average tensile strength was 98.5 (Kg/mm²), such thereby presenting considerable improvements in the cooling effect and uniformity of cooling of the rod.

FIG. 16(III) similarly shows the cooling rates of the rods disposed within the cooling apparatus shown within FIG. 14 according to the present invention, wherein the angles of the nozzle portions used were as follows: $\theta 1 = 45°$, $\theta 2 = 45°$, $\theta 3 = 45°$, $\theta 4 = 90°$, and $\theta 5 = 45°$. In addition to this, there were used nozzle portions, through which the cooling fluid was projected upwardly, which were disposed within the cooling bed at positions directly below the chains. The standard variation in the tensile strength $\sigma$ obtained was 1.17 (Kg/mm²), and the average tensile strength $\bar{x}$ was 99.2 (Kg/mm²). The cooling rate at the CC portions is seen to be improved when compared with the example of FIG. 16(II).

FIG. 16 (IV) shows the cooling rates of the rods disposed within the cooling apparatus shown within FIG. 13 according to the present invention, the angles of the nozzle portions used being as follows: $\theta 1 = 45°$, $\theta 2 = 45°$, $\theta 3 = 45°$, $\theta 4 = 90°$, and $\theta 5 = 45°$. In addition to this, there were used nozzle portions, through which the cooling fluid was projected upwardly from positions disposed directly below the chains, and the rails disposed within one cooling floor were arranged so as to be out of lengthwise alignment with those disposed within another floor. The standard variation in tensile strength $\sigma$ obtained was 1.02 (Kg/mm²), and an average tensile strength $x$ was 99.8 (Kg/mm²). According to this example, complete uniformity in the cooling rate was substantially obtained.

It is to be noted that the rods used herein were of a diameter of 5.5 mm and of a hard steel containing 0.62% carbon, and 0.42% manganese, and the flow velocity of the air being projected through the nozzle portions was 35m/sec.

As is apparent from the foregoing description of the cooling apparatus constructed according to the present invention, various improvements are given in the arrangement, construction and configuraton of the nozzle portions which are formed within the bodies of the cooling bed itself, with the result that minimized variations in the mechanical strength, that is, improvements in the quality of the rod, are achieved. During the transportation of a rod through the cooling apparatus, the rod is not subjected to vibration, oscillation, nor travels in a zig-zag pattern, thus presenting no possibility of the occurrence of cracking of the skin of the rod or any type of damage thereto, while the configurations of the respective loops of the rod of the coil form may nevertheless be maintained in a satisfactory manner.

In addition, the nozzles should not necessarily be provided separately of the cooling bed because as the nozzle portions are integrally formed within the body of the cooling bed, considerable economy is attained. Still further, the cooling bed if required, may be reversed in direction with respect to the transporting direction of the rod so as to enhance the cooling effect of the fluid upon the rod. The rails disposed within one cooling floor may be arranged out of lengthwise alignment with those disposed within another floor in accordance with some instances of the cooling apparatus of the present invention in an attempt to provide uniform cooling for such portions of the rod which contact the rails during the transportation thereof. Yet further, the nozzle portions are disposed directly below the chains for improving the cooling effect of the fluid upon such portions of the rod, which are gripped or hooked by means of the fingers of the chains.

Obviously, many modifications and variations of the present invention are possible in light of the above teachings. It is therefore to be understood that within the scope of the appended claims, the present invention may be practiced otherwise than as specifically described herein.

What is claimed as new and desired to be secured by letters patent of the United States is:

1. A method for cooling a rod of a coil form immediately after hot-rolling thereof, wherein said rod, whose loops are spaced a given pitch from one another, is laid flat upon rails of a planar cooling bed and conveyed therealong in a transporting direction by means of endless chains during which time said rod is cooled with cooling fluid which is being projected from below said cooling bed, said method comprising the steps of:

projecting said cooling fluid upwardly, such that said projected fluid is directed at an angle within the range of 10° – 70° with respect to the plane of said cooling bed and as viewed orthogonally with respect to said plane of said cooling bed within the range of 10° – 150°0 with respect to the transporting direction of said rod, toward said rod disposed directly above said rails and chains of said cooling bed; and projecting said cooling fluid upwardly, such that said projected fluid is directed at an angle within the range of 15° – 75° with respect to the plane of said cooling bed and as viewed orthogonally with respect to said plane of said cooling bed within the range of 30° – 150° with respect to the transporting direction of said rod, toward the overlapped lateral circumferential portions of a series of loops of said rod.

2. A method for cooling a rod of a coil form as set forth within claim 1, wherein:

said cooling fluid is projected upwardly, at an angle preferably within the range of 15° – 60° with respect to the plane of said cooling bed and as viewed orthogonally with respect to said plane of said cooling bed preferably within the range of 30° – 120° with respect to the transporting direction of said rod, toward said rod disposed directly above said rails and chains.

3. An apparatus for cooling a rod of a coil form, immediately after hot-rolling thereof, wherein said rod, whose loops are spaced a given pitch from one another, is laid flat upon rails of a planar cooling bed and conveyed therealong in a transporting direction by means of endless chains during which time said rod is cooled with cooling fluid which is being projected from below said cooling bed, comprising:

first nozzle portions, through which said cooling fluid is projected upwardly, at an angle within the range of 10° – 70° with respect to the plane of said cooling bed, and as viewed orthogonally with respect to said plane of said cooling bed within the range of 10° – 150° with respect to the transporting direction of said rod through said cooling bed, toward said rod disposed directly above said rails and chains of said cooling bed; and second nozzle portions, through which said cooling fluid is projected upwardly, at an angle within the range of 15° – 75° with respect to the plane of said cooling bed, and as viewed orthogonally with respect to said plane of said cooling bed within the range of 30° – 150° with respect to the transporting direction of said rod, toward the overlapped lateral circumferential portions of a series of loops of said rod.

4. An apparatus for cooling a rod as set forth within claim 3, wherein:

said first nozzle portions are preferably disposed at an angle within the range of 15° – 60° with respect to the plane of said cooling bed, and as viewed orthogonally with respect to said plane of said cooling bed within the range of 30° – 120° with respect to the transporting direction of said rod.

5. An apparatus for cooling a rod of a coil form, as set forth within claim 3, further comprising:

third nozzle portions provided within said cooling bed and disposed immediately below said chains.

6. An apparatus for cooling a rod of a coil form as set forth within claim 3, wherein:

said rails within one cooling bed are arranged out of lengthwise alignment with the rails within another cooling bed.

7. An apparatus for cooling a rod of a coil form as set forth within claim 6, further comprising:

third nozzle portions provided within said cooling bed and disposed immediately below said chains.

* * * * *

UNITED STATES PATENT AND TRADEMARK OFFICE

CERTIFICATE OF CORRECTION

PATENT NO. : 4,023,392

DATED : May 17, 1977

INVENTOR(S) : Fujita et al.

It is certified that error appears in the above-identified patent and that said Letters Patent are hereby corrected as shown below:

Column 4, line 33, change "appratus" to --apparatus--.

Column 4, line 44, change "6" to --16--.

Column 5, line 3, change "conditon" to --condition--.

Column 8, line 30, change "flud" to --fluid--.

Column 8, line 41, change "dispositon" to --disposition--.

Column 8, line 60, change "dispositon" to --disposition--.

Column 9, line 57, change "porton" to --portion--.

Column 10, line 29, change "x" to --$\bar{x}$--.

Column 10, line 41, change "configuraton" to --configuration--.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarl*